US005293009A

United States Patent [19]

Fleischer

[11] Patent Number: 5,293,009

[45] Date of Patent: Mar. 8, 1994

[54] DUST PROTECTION CAP FOR CONICAL LOUDSPEAKER

[75] Inventor: Rudiger Fleischer, Grafling, Fed. Rep. of Germany

[73] Assignee: Nokia (Unterhaltungselektronik/(Deutschland) GmbH, Pforzheim, Fed. Rep. of Germany

[21] Appl. No.: 886,069

[22] Filed: May 20, 1992

[51] Int. Cl.[5] ..... G10K 13/00

[52] U.S. Cl. ..... 181/169; 181/171

[58] Field of Search ..... 181/167, 169, 171, 172, 181/173, 164, 165

[56] References Cited

U.S. PATENT DOCUMENTS 2,858,680 1/1975 Tsuge et al. ..... 181/167 X
4,190,746 2/1980 Harwood et al. ..... 181/167 X
4,478,309 10/1984 Kawamura et al. ..... 181/167

FOREIGN PATENT DOCUMENTS 3524280 1/1987 Fed. Rep. of Germany .
3609832 9/1987 Fed. Rep. of Germany .
0042112 4/1977 Japan ..... 181/169
832784 5/1981 U.S.S.R. .

*Primary Examiner*—Richard A. Wintercorn
*Assistant Examiner*—Khanh Dang
*Attorney, Agent, or Firm*—Ware, Fressola, Van Der Sluys & Adolphson

[57] ABSTRACT

A conical loudspeaker (10) has a dust protection cap (23) of hot-pressed polymer foam. Dust protection caps (23) made from this material are largely insensitive to finger pressure and can be attached to the conical speaker membrane using simple adhesives. Preferably the outer rim of the conical speaker membrane is secured by a lock beading (14) made from the same foam as the dust protection cap (23). This has the advantage that if the pressing die is suitably configured, the dust protection cap (23) can be made from the portion of the foam mat that otherwise, if only a lock beading (14) was being produced, would be left over in the center of the foam mat.

5 Claims, 1 Drawing Sheet

DUST PROTECTION CAP FOR CONICAL LOUDSPEAKER

FIELD OF THE INVENTION

Figure 1:
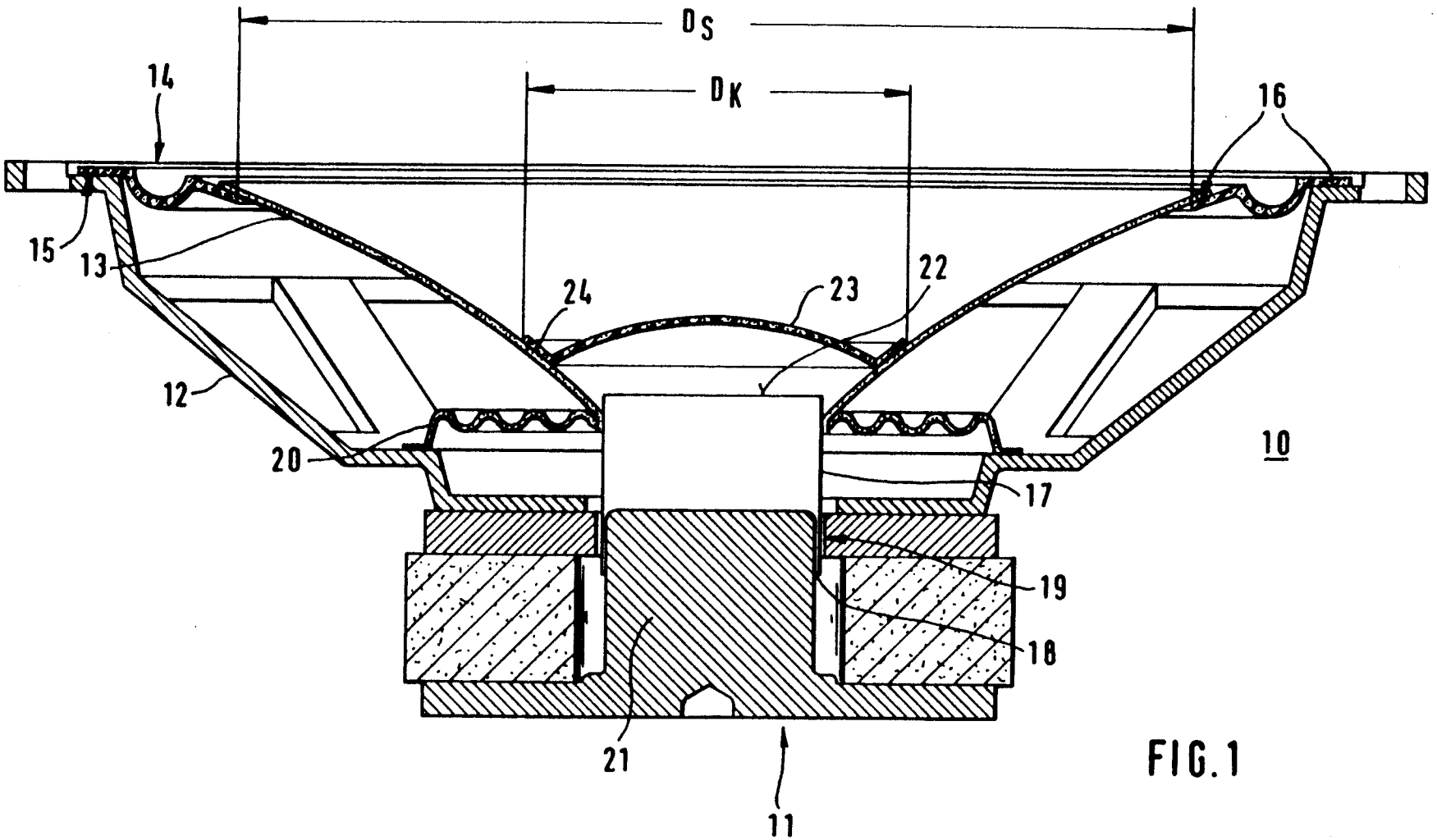

The invention concerns the construction of dust protection caps for conical loudspeakers.

RELATED ART

In view of the familiarity and wide distribution of conical loudspeakers, the reader is referred for a more detailed description of this loudspeaker to the article in the periodical Funkschau 1983, volume 7, page 99, FIG. 1. The important aspect of the present invention is the fact that the upper opening of the moving coil support is hermetically sealed by means of a dust protection cap having a domed shape, with the rim of the dust protection cap being glued to the inner surface contour of the conical membrane.

The upper or front opening of the moving coil support, which is unavoidable due to manufacturing engineering reasons, should be covered with a dust protection cap, because dirt particles need to be kept away from the air gap in the magnet assembly. A tight seal is also necessary in order to be able to both implement a housing synthesis according to the usual processes—for example Thiele-Small—and to eliminate undesired sound components, which may occur in the moving coil support and in the air gap, from the desired sound.

Although a large number of materials meet the criterion of sealing ability that may easily be deduced from the above remarks, by no means are all of these materials suitable for use as the material for dust protection caps. The reason is that in addition to the geometry of the cap and the adhesive used between the cap and the conical membrane, the material from which the dust protection cap is made also has an influence on the reproduction characteristics of the loudspeaker. Paper, cloth, metal foils, and plastic films have proven to be acceptable materials for dust protection caps.

Paper caps, which have largely neutral acoustic characteristics, are relatively expensive and can very easily be damaged by the pressure of a finger. Even if they are attached on the membrane, paper caps can be coated with damping materials.

Cloth as a material for dust protection caps requires a coating, without which the necessary sealing ability is absent. Like paper caps, they are relatively sensitive to finger pressure.

Metal foils are expensive and also extraordinarily sensitive.

With regard to plastic films, a distinction must be made between hard and soft films. Although caps are still occasionally made from hard plastic films, consideration of this type of cap is not necessary, since (especially in high-quality loudspeakers) the caps are in most cases produced from soft plastic films. The reason for the increasing use of caps made from soft PVC is that this material also has very neutral acoustic characteristics.

Moreover, caps made from the material just described cannot be damaged even by very strong finger pressure, since deformations of the cap return to the original form because of the material properties of soft PVC.

A disadvantage of soft PVC caps, however, is that they are not without health risks. Moreover, handling of these caps is quite laborious, since caps made from soft PVC tend to stick together when they are, for example, stacked together for transport. Expensive and complex special adhesives ar needed to glue soft PVC caps to other plastics, for example to a conical membrane made of plastic. Also, caps made of soft PVC cannot be coated later on with damping materials.

The object of the present invention is therefore that of providing a dust protection cap that eliminates the aforesaid disadvantages.

SUMMARY OF THE INVENTION

This object is achieved by forming the dust protection cap from a hot-pressed foam. This material is acoustically very neutral and is already used to produce the lock beading anchoring the peripheral rim of the conical membrane to the loudspeaker basket rim (compare, for example, DE-P 41 11 748.4).

Hot pressed foam acquires the impermeability to air required for the production of caps as a result of the pressing process. Since caps produced from hot-pressed foam are pliable and elastic, these caps are also largely insensitive to finger pressure, since deformations of the dust protection cap always return to their original form. Dust protection caps made from hot-pressed foam are also very easily glued to other materials, including plastic.

Expensive special adhesives are not necessary. Instead in many cases it is sufficient to use simple dispersion adhesives. Although dust protection caps made from hot-pressed foam already have good damping characteristics, these caps can still be additionally coated with damping materials.

If, according to one aspect, the lock beading is also made from hot-pressed foam, this has the advantage that loudspeaker production in general can thereby be simplified. In particular, this eliminates excessive material and machinery inventory.

It is very particularly advantageous if both the lock beading and the dust protection cap are made from one and the same material. The reason is that when a lock beading alone is produced from a foam panel, a waste piece remains behind in the center (cf. for example DE-P 41 11 748.4). This waste piece can, if the pressing die is suitably configured, be utilized to manufacture dust protection caps, by pressing the dust protection cap from the foam mat simultaneously with the pressing operation to produce the lock beading.

Soft polyurethane foam material can be used both for the lock beading and for the dust protection cap.

THE DRAWING

FIG. 1 is a cross-sectional elevation view of a loudspeaker incorporating the present invention.

PREFERRED EMBODIMENTS OF THE INVENTION

The invention will now be illustrated with reference to the single FIGURE.

This FIG. 1 shows a conical loudspeaker 10 in section. Fitted onto a magnet assembly 11 is a loudspeaker basket 12, which is approximately conical in shape. Arranged in loudspeaker basket 12 is a membrane 13, also conical in shape.

The front end of membrane 13 which has the greater of the two diameters is attached by means of a circumferential lock beading 14 to outer rim 15 of loudspeaker basket 12. Regions 16 of lock beading 14 are glued to membrane 13 and to outer rim 15 of loudspeaker basket 12. Lock beading 14, including its adhesion regions 16, is made of hot-pressed soft polyurethane foam.

A tubular moving coil support 17 is fitted onto and anchored to the other, rear end of membrane 13. The rear free end 18 of moving coil support 17 projects into an air gap 19 of magnet assembly 11. A centering membrane 20, which attaches moving coil support 17 to loudspeaker basket 12, ensures that moving coil support 17 is centered with respect to pole core 21 of magnet assembly 11 in every operating state of conical loudspeaker 10.

Front opening 22 of moving coil support 17 is hermetically sealed with a dust protection cap 23 by gluing a rim 24, formed on dust protection cap 23, to the inner surface contour of membrane 13. Dust protection cap 23, like lock beading 14, is made of hot-pressed soft open-cell polyurethane foam.

It should also be mentioned that the utilization of soft polyurethane form is not mandatory. Instead, in other embodiments, any other foamed and hot-pressable foam can also be used.

Since the smallest inside diameter $D_s$ of lock beading 14 is always considerably larger than the largest outside diameter $D_k$ of dust protection cap 23, it can also immediately be understood that the dust protection cap was formed, by appropriate configuration of the pressing dies, from the parts of the foam mat being pressed that would otherwise have remained unused in the center if lock beading 14 alone were being produced.

In addition to the configuration of the dust protection cap just indicated, which is highly economical of material, in another embodiment lock beading 14 and dust protection cap 17 can also be made of different materials.

What is claimed is:

1. A conical loudspeaker (10) comprises:

a magnet assembly (11) having an air gap (19);

a loudspeaker basket (12) having an upper forward rim (15);

a conical membrane (13) that is arranged in the loudspeaker basket (12), having a sound-delivering inner surface contour and having a forward end of larger diameter and a rear end of smaller diameter, with the forward end of the membrane (13) being anchored by means of a circumferential lock beading (14) to the upper forward rim (15) of the loudspeaker basket (12), and the other rear end of the membrane (13) having a tubular moving coil support (17) anchored thereon, projecting into the air gap (19) of the magnet assembly (11) and having a front opening (22); and a dust protection cap (23) that is glued to the inner surface contour of the membrane (13) and which encloses and hermetically seals the front opening (22) of the moving coil support (17);

characterized in that the dust protection cap (23) is made of hot-pressed foam.

2. A conical loudspeaker according to claim 1, characterized in that the lock beading (14) is also made of hot-pressed foam.

3. A conical loudspeaker according to claim 2, characterized in that the lock beading (14) and the dust protection cap (23) are made from identical material.

4. A conical loudspeaker according to claim 3, characterized in that the material is an open-cell soft polymer foam.

5. A conical loudspeaker according to claim 3, characterized in that the material is an open-cell soft polyurethane foam.

* * * * *